United States Patent [19]

Coble et al.

[11] Patent Number: 4,467,626

[45] Date of Patent: Aug. 28, 1984

[54] SOCK WITH DOUBLE-LAYER FABRIC IN FOOT AND METHOD

[75] Inventors: William H. Coble; Harper Shields, both of Burlington; Roscoe M. Farrell, Pittsboro, all of N.C.

[73] Assignee: Kayser-Roth Hosiery, Inc., New York, N.Y.

[21] Appl. No.: 462,707

[22] Filed: Jan. 31, 1983

[51] Int. Cl.[3] ..... D04B 7/04

[52] U.S. Cl. ..... 66/196; 66/185; 66/178 R

[58] Field of Search ..... 2/239; 66/178 R, 170, 66/185, 186, 187, 196, 202, 174

[56] References Cited

U.S. PATENT DOCUMENTS

| | | | |
|---|---|---|---|
| Re. 5,802 | 3/1874 | Tripp | 66/174 |
| 142,301 | 8/1873 | Tripp | 66/174 |
| 709,734 | 9/1902 | Bellis | 66/196 |
| 1,434,941 | 11/1922 | Boyd | 66/178 X |
| 2,144,563 | 1/1939 | Davis | 66/185 |
| 2,714,813 | 8/1955 | Hill | 66/178 |
| 2,879,654 | 3/1959 | Evans | 66/176 |
| 3,107,510 | 10/1963 | Manger | 66/183 |
| 3,259,915 | 7/1966 | Dison | 2/236 |
| 3,307,379 | 3/1967 | Woolley et al. | 66/178 |
| 3,796,067 | 3/1974 | East | 66/178 |
| 4,047,400 | 9/1977 | Thorneburg | 66/171 |
| 4,341,096 | 7/1982 | Safrit et al. | 66/196 |

FOREIGN PATENT DOCUMENTS

| | | | |
|---|---|---|---|
| 1079781 | 4/1960 | Fed. Rep. of Germany | 66/41 |
| 2454766 | 12/1980 | France | 66/178 |
| 29818 | 12/1916 | Norway | 66/178 |
| 1084281 | 9/1967 | United Kingdom | 66/41 |

*Primary Examiner*—Ronald Feldbaum

*Attorney, Agent, or Firm*—Bell, Seltzer, Park & Gibson

[57] ABSTRACT

The double-layer fabric extends throughout at least a substantial portion of the foot of the sock and both the inner and outer layers of the double-layer fabric in the foot include the same number of wales as the number of wales in the leg portion of the sock. The sock can be knit on a conventional hosiery knitting machine provided with a single set of needles and special sinkers for holding the stitch loops of the last course of the leg while the inner and outer layers of the foot portion of the sock are being knit. The double-layer fabric in the foot of the sock provides improved cushioning and moisture-absorbing characteristics to the sock.

14 Claims, 16 Drawing Figures

SOCK WITH DOUBLE-LAYER FABRIC IN FOOT AND METHOD

FIELD OF THE INVENTION

This invention relates generally to a sock including a double-layer fabric extending completely around the foot portion and method of knitting the sock on a knitting machine having one set of needles, and more particularly to such a sock and method in which both layers of the foot contain the same number of wales as the leg and remaining portion of the sock and wherein the double layers in the foot portion impart improved cushioning and moisture-absorbing characteristics thereto.

BACKGROUND OF THE INVENTION

U.S. Pat. No. 4,341,096, assigned to the same assignee, discloses a sock with triple-layer fabric in a substantial portion of the foot for providing cushioning and moisture-absorbing characteristics thereto. The inner and intermediate layers of the foot of the sock of this patent are knit with a lesser number of wales than the number of wales in the outer layer and the remaining portion of the sock. The formation of triple-layer fabric in the foot of the sock may, in some instances, provide more cushioning and a thicker fabric in the foot portion than is desirable. The knitting of the inner and intermediate layers of the sock of said patent with a lesser number of wales than the outer layer and the remaining portions of the sock is accomplished by holding spaced-apart stitch loops on the needles while maintaining these needles in an inactive or nonknitting position during the knitting of the inner and intermediate layers of the foot of the sock.

It is known to knit socks with double-layer fabric in the sole or lower half of the foot, of the type disclosed in U.S. Pat. Nos. 2,714,813 and 3,107,510. U.S. Pat. No. 3,307,379 discloses a sock with double-layer fabric extending throughout the foot and a major portion of the leg, with the double-layer fabric being integrally knit in spaced-apart wales. The knitting of the socks of these three patents requires the use of a knitting machine having two sets of needles with one fabric layer being formed on one set of needles and the other fabric layer being formed on the other set of needles.

SUMMARY OF THE INVENTION

With the foregoing in mind, it is an object of the present invention to provide a sock and method of knitting the same which includes the knitting of double-layer fabric for at least a substantial portion of the foot and completely around the portion of the length of the foot while knitting the same number of wales in the inner and outer layers of the foot as the number of wales which are knit in the remaining single-layer portion of the sock. The same number of wales are formed in the inner and outer layers of the foot portion of the sock by holding the last course of stitch loops of the adjacent single-layer fabric on the needles and at a position below the latches thereof while the needles continue to knit during the knitting of the inner and outer layers of the foot portion. The moisture-absorbing characteristics of the foot portion of the present sock may be enhanced by knitting the inner layer of hydrophobic yarn and knitting the outer layer at least in part of hydrophilic yarn so that the moisture from the foot of the wearer is wicked through the inner layer and into the outer layer and evaporated therefrom. The adjacent corresponding sides of one or both of the inner and outer layers of the foot of the sock may be provided with terry loops to enhance the cushioning characteristics of the foot of the sock.

In accordance with the present invention, the sock blank is knit on a knitting machine having only a single set of needles. The rear or upper ends of the double-layer fabric in the foot are integrally knit together and joined to the remainder of the single-layer portion of the sock and the forward or lower ends of the double-layer fabric are joined together by a toe closure seam of appropriate configuration. If desired, the inner and outer layers of the foot may be connected together at an intermediate location, such as by one or more lines of stitching extending around the foot.

The double-layer fabric may be knit throughout the entire foot portion of the sock, including the toe, heel, sole and instep areas, as illustrated in the drawings, or the double-layer fabric in the foot may extend rearwardly only to a medial portion of the foot and the heel and leg may be knit of single-layer fabric. The sock illustrated in the drawings is of the "heelless" tube type. However, when the double-layer fabric extends rearwardly through the toe and ball area and terminates at substantially the midpoint of the foot, a single-layer conventional type of reciprocatorily knit heel pocket may be provided.

The sock of the present invention is knit on a conventional type of circular hosiery knitting machine including a circle of latch needles with sinkers between the needles and with the sinkers being provided with a special stitch loop holding and transferring slot extending below the usual stitch-forming throat of the sinkers. In knitting the sock of the present invention, the single-layer leg of the sock is formed by forming stitch loops on all needles and knitting successive courses while inlaying elastic yarn to form a mock rib, if desired. The stitch loops of the last course of the single-layer fabric are transferred and held in an abnormally low position by the sinkers so that the stitch loops are maintained below the latches of the needles. The knitting of the double-layer fabric in the foot portion begins by forming a makeup on the needles and knitting the inner layer of the foot on all needles while continuing to hold the stitch loops of the last course of the leg or single-layer fabric below the latches of the needles. After the desired length of fabric has been knit to form the inner layer of the foot portion, the held stitch loops of the last course of the single-fabric area or portion are transferred to a position above the latches of the needles so that these stitch loops are cast off and joined with the stitch loops in the last course of the inner layer of the foot. Knitting then continues on all needles to knit the first course of the outer layer of the foot integral with the last course of the inner layer of the foot and with the last course of the single-layer fabric so that the single-layer fabric is joined to the juncture of the inner and outer layers of the double-layer foot portion. Knitting continues on all needles to form substantially the same length of fabric in the outer layer as the length of fabric in the inner layer and the sock blank is then cast from the needles of the knitting machine with the inner layer of the fabric extending through the single-layer leg and with the outer layer of the foot portion extending from the single-layer leg. The sock is completed by drawing the inner layer of the foot through the single-layer leg and into the inside of the outer layer of the foot portion so that the ends of the inner and outer layers are substantially in alignment. The free forward or lower ends of the inner and outer layers are then joined together by a toe closure seam to complete the sock.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
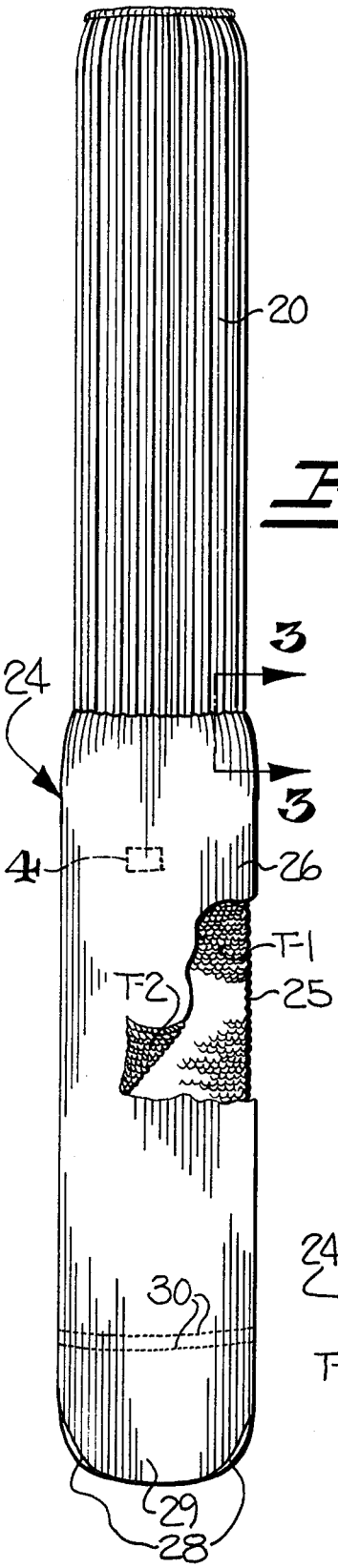
FIG. 1 is an elevational view of the sock of the present invention in flattened condition and with a portion of the outer layer of the foot portion broken away and folded back to show the inner layer.

The sock of the present invention includes a leg 20 knit of successive courses including a predetermined number of stitch loops forming adjacent wales in the successive courses. The leg 20 is preferably of the "mock rib" type which is formed in the well-known manner by inlaying an elastic yarn in spaced-apart wales, such as every fourth wale, and floating the elastic yarn inside of the intervening three wales to provide the mock rib appearance. The mock rib leg 20 is integrally knit with a foot portion, broadly indicated at 24, and which includes an inner layer 25 and an outer layer 26, the upper ends of which are joined to each other and to the last course of stitch loops of the leg 20, in a manner to be presently described. The inner and outer layers 25, 26 extend completely around the foot portion 24.

Figure 2:
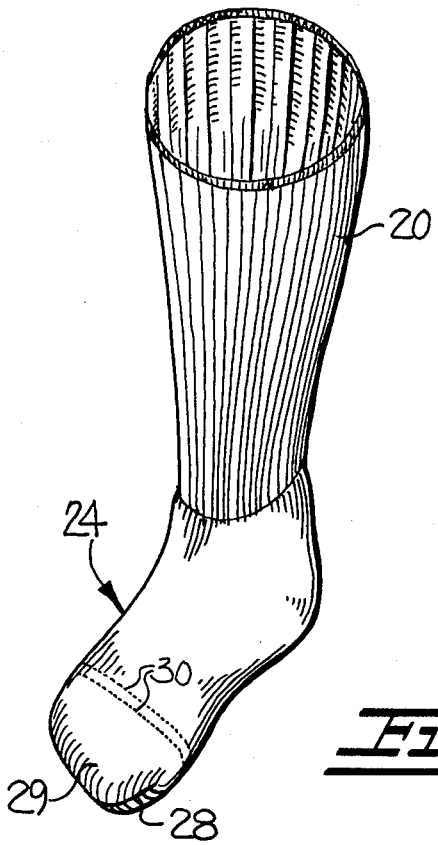
FIG. 2 is a perspective view of the sock of FIG. 1, showing the appearance of the sock when worn.

The forward or lower ends of the inner and outer layers 25, 26 are joined together by an overedge toe closure seam 28 to provide a toe pocket or area 29. When the sock is worn, as illustrated in FIG. 2, the closure seam 28 extends around the ends of the toes of the wearer and the double-layer foot 24 extends upwardly to cover the heel and is joined to the lower end of the leg 20 around the ankle of the wearer.

The illustrated foot 24 is of the tube or heelless type; however, it is to be understood that the double-layer foot 24 may begin around the middle of the foot so that the single-layer fabric would extend around the heel and throughout the initial part of the foot and this single-layer fabric could include a reciprocatorily knit heel pocket, if desired. In this instance, the two-layer foot portion 24 would cover the toes and ball of the foot of the wearer while the remainder of the foot and the heel area would be single-layer fabric. As illustrated in FIGS. 1 and 2, the double-layer foot portion 24 includes the toe, heel, sole and instep areas, as well as an area above the heel and surrounding the ankle of the wearer.

Figure 3:
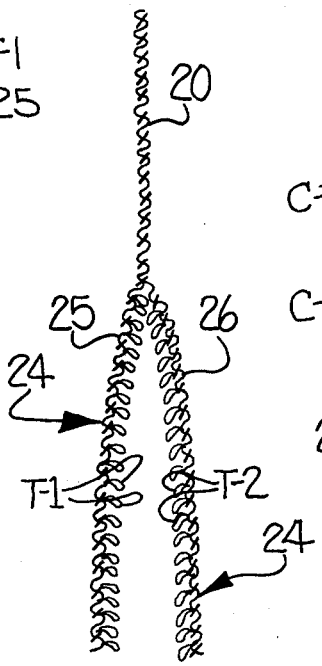
FIG. 3 is an enlarged vertical sectional view taken substantially along the line 3—3 in FIG. 1.

The inner and outer layers 25, 26 of the foot portion 24 include an equal number of wales and the number of wales in the inner and outer layers 25, 26 is the same number of wales as the number of wales in the leg 20. To enhance the moisture-absorbing characteristics of the double-layer foot portion, the inner layer 25 may be knit of hydrophobic yarn, such as nylon, and the outer layer 26 may be knit at least in part of hydrophilic yarn, such as cotton, so that the moisture from the foot of the wearer is wicked through the inner layer 25 and into the outer layer 26 where it is evaporated therefrom. To enhance the cushioning characteristics of the double-layer foot portion, the adjacent corresponding surfaces of the inner and/or outer layers 25, 26, may be provided with terry loops respectively indicated at T-1 and T-2 in FIGS. 1 and 3.

Figure 4:
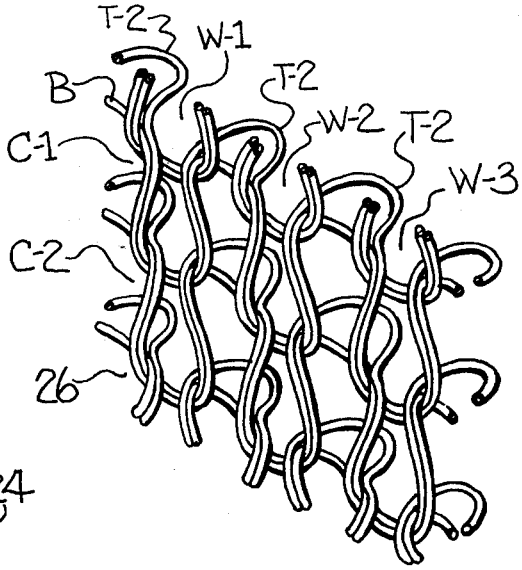
FIG. 4 is a greatly enlarged isometric view of a fragmentary portion of the outer layer of the foot portion, taken substantially in the rectangular area 4 of FIG. 1 and illustrating the manner in which the terry loops extend inwardly of the inner and outer layers of the foot.
Figure 5:
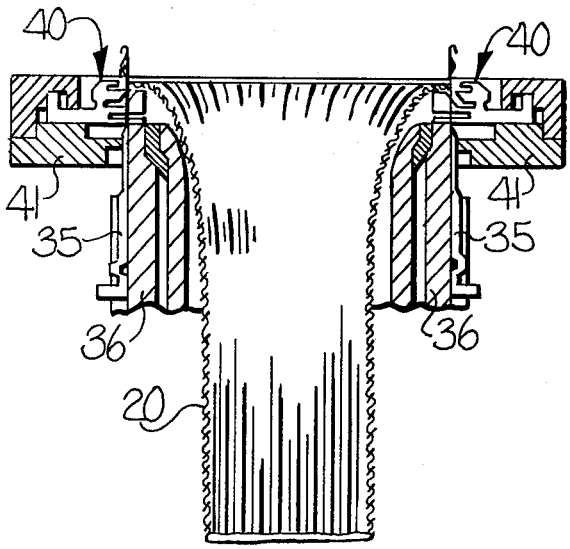
FIG. 5 through 8 are somewhat schematic cross-sectional views through the needle cylinder of a conventional type of hosiery knitting machine and schematically illustrating the progressive knitting of the various portions of the sock.

As illustrated in FIG. 4, the outer layer 26 is knit with a body yarn B to form adjacent wales of stitch loops in wales W-1, W-2 and W-3 of successive courses C-1 and C-2. A terry yarn T is knit in plated relationship with body yarn B in the needle wales while forming inwardly extending terry loops T-2 in the sinker wales therebetween. The terry loops may be formed in any conventional manner during the knitting of the inner layer 25 and/or the outer layer 26.

In certain constructions of the sock of the present invention, the inner layer 25 may have a tendency to stretch to a greater extent than the outer layer 26, particularly after the sock has been worn and laundered several times. If this occurs, the inner layer 25 may tend to be pushed down and form uncomfortable wrinkles inside of the outer layer when the sock is drawn onto the foot of the wearer. To overcome this possible problem, it may be desirable to provide stitching means to connect together the inner and outer layers 25, 26 at one or more locations rearwardly of the toe pocket 29. The stitching means is illustrated in FIGS. 1 and 2 in the form of spaced-apart parallel rows or lines of stitching 30 which penetrate the inner and outer layers 25, 26 and may be interconnected on the inside of the inner layer 25 by a zig-zag interconnecting thread, not shown. The location of the lines of stitching 30 may be varied and is illustrated as extending around the foot at a location at the rear of the position engaged by the ball of the foot.

METHOD OF KNITTING

As schematically illustrated in FIGS. 5–8, the sock of the present invention is knit on a conventional type of hosiery knitting machine having a circle of latch needles 35 supported for vertical sliding movement in the slots of a needle cylinder 36. Sinkers, broadly indicated at 40, cooperate with the needles 35 in forming the successive courses of stitch loops and are supported for radial movement in radial slots in a sinker head 41. As illustrated in FIGS. 10–16, the sinkers 40 each include an outermost upstanding operating butt 42, a nib 43 and a stitch-forming ledge or throat 44. The special type of sinker utilized in knitting the sock of the present invention also includes a stitch loop transferring and holding slot with an inclined portion 45 extending downwardly and inwardly from the stitch-forming ledge 44 and a horizontal stitch-holding portion 46 spaced well below the stitch-forming ledge 44.

Figure 10:
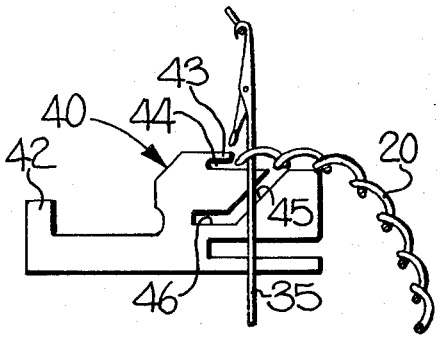
FIGS. 10 through 16 are schematic elevational views illustrating the special type of sinker and manner in which it cooperates with the needles during the knitting of the various portions of the sock.
Figure 11:
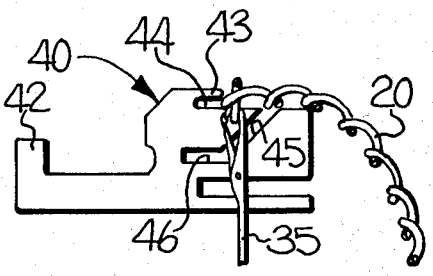

The knitting begins at the upper end of the leg 20 by knitting a conventional selvage or makeup and feeding a body yarn to form stitch loops on all of the needles 35 while inlaying a covered elastic yarn in every fourth wale of every course to form the mock rib appearance and to knit the proper number of courses to form the desired length of the leg 20. During the knitting of the leg 20, the tubular fabric is fed downwardly through the needle cylinder 26 in the manner indicated in FIG. 5. Also, during the knitting of the leg 20, the needles 35 and sinkers 40 cooperate in the usual manner as illustrated in FIGS. 10 and 11, to form successive courses of stitch loops. As shown in FIG. 10, the latch needles 35 are successively raised at the knitting station to pick up the body yarn and the previously formed stitch loop is lowered below the lower end of the latch to a shed position. The needles are then successively lowered to form new stitch loops over the normal stitch loop-forming ledges 44 and to cast the previously formed stitch loops therefrom, closing the latch, as illustrated in FIG. 11.

Figure 12:
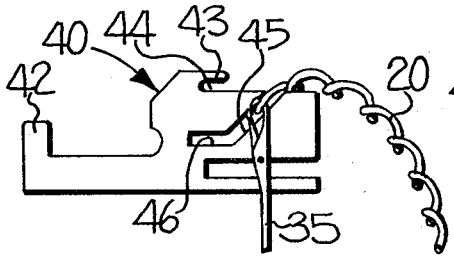
Figure 13:
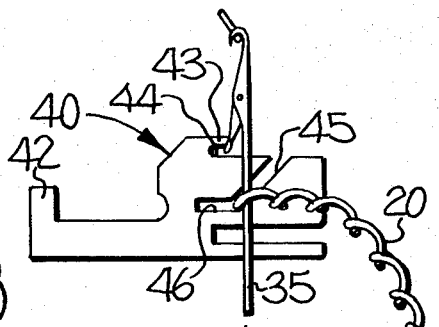

When the proper number of courses have been knit to form the desired length of leg 20, the stitch loops of the last course of the leg 20 are transferred to an abnormally low position on the needles 35 to be held below the latches during the knitting of the inner layer 25 of the foot portion 24. This transfer of the stitch loops of the last course of the leg 20 is illustrated in FIGS. 12 and 13. As the successive stitch loops of the last course of the leg 20 are knit, the sinkers 40 are successively drawn outwardly a greater than normal distance and the corresponding latch needles 35 on either side are lowered to cause the sinker loop associated with the adjacent stitch loops to be drawn down into the inclined slot 45, as illustrated in FIG. 12. The sinker 40 is then moved inwardly as the adjacent needles 35 are raised, as illustrated in FIG. 13, to cause the sinker loop to be forced down the inclined slot 45 and into the horizontal stitch holding slot 46 in the sinker 40. The stitch loops of the last course of the leg 20 are thus transferred to an abnormally low position and held below the latches of the needles 35 while the inner layer 25 of the foot is knit on all of the needles.

Figure 6:
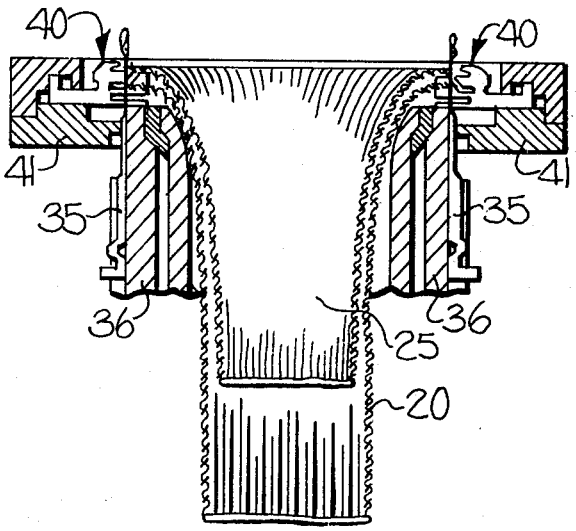
Figure 7:
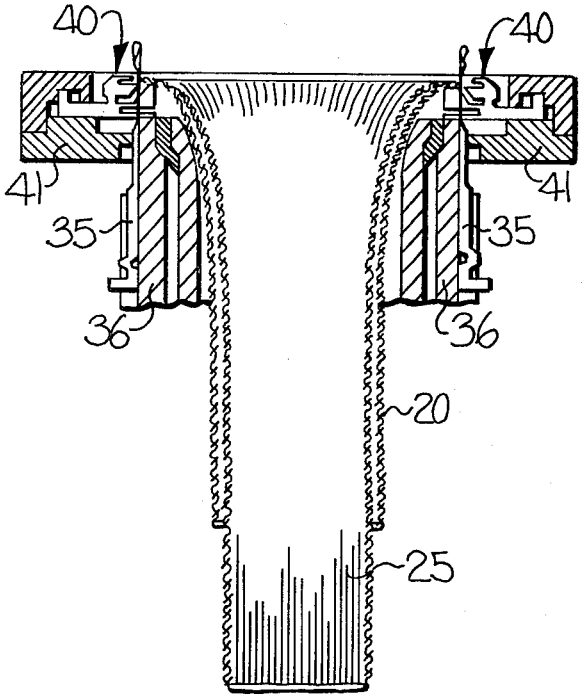

As illustrated in FIG. 13, alternate needles 35 are successively raised as they approach the knitting station to pick up a body yarn and form a selvage or makeup at the lower end of the inner layer 25, while continuing to hold the stitch loops of the last course of the leg 20. Knitting of the inner layer 25 continues on all needles 35, as illustrated in FIG. 6, until the proper number of courses have been knit to form the desired length of the inner layer 25, as illustrated in FIG. 7. The inner layer 25 extends downwardly through the needle cylinder 36 and inside of the leg 20.

Figure 14:
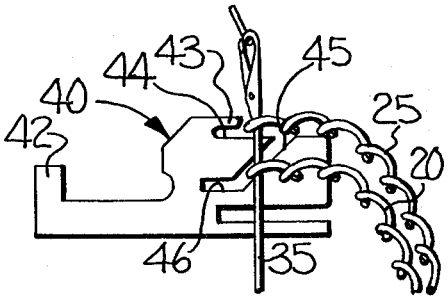
Figure 15:
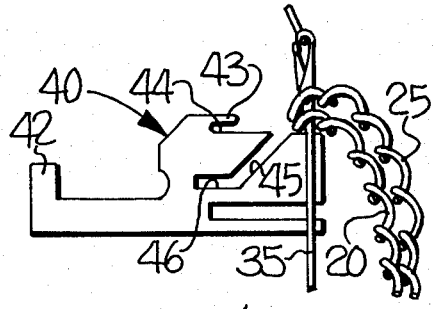

Upon completion of the knitting of the inner layer 25, the held stitch loops of the last course of the leg 20 are raised upwardly and joined with the stitch loops of the last course of the inner layer 25 and are interknit with the stitch loops of the first course of the outer layer 26 in the manner illustrated in FIGS. 14 and 15. When the needles 35 are successively raised at the knitting station and pick up the body yarn to form the first course of the outer layer 26, as illustrated in FIG. 14, the sinkers 40 are successively withdrawn or moved outwardly to a greater than normal extent, as illustrated in FIG. 15, so that the held stitch loops of the last course of the leg 20 are raised upwardly to the normal level of the stitch-forming ledge 44 and they are joined with the last stitch loops of the last course of the inner layer 25.

Figure 8:
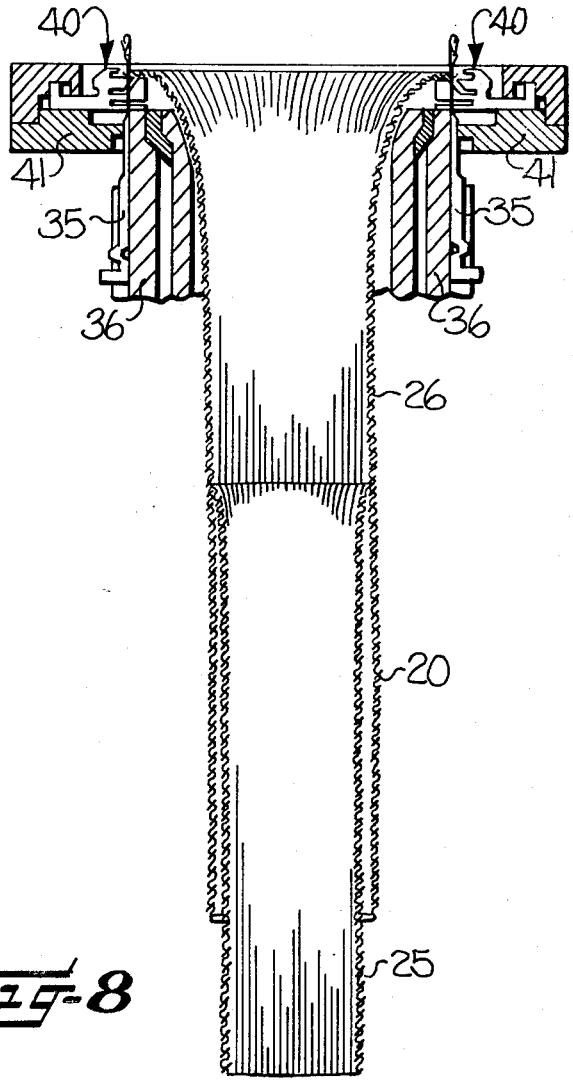
Figure 9:
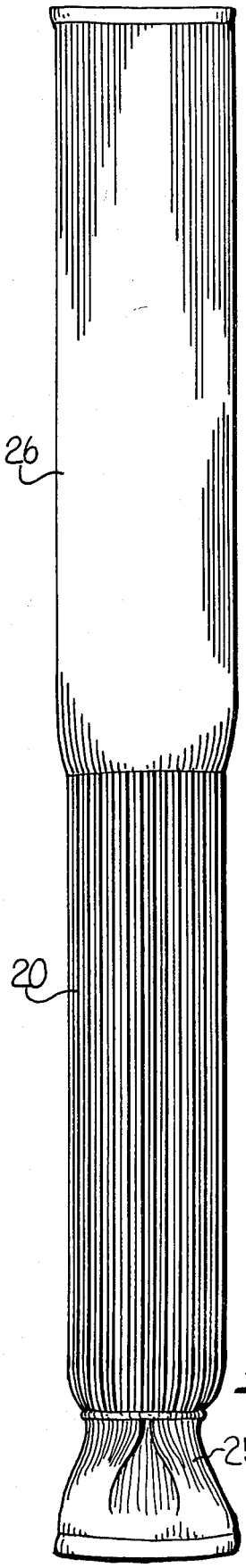
FIG. 9 is an elevational view of the sock of the present invention in flattened condition and illustrating the appearance of the sock when it is first cast from the knitting machine with the inner layer of the foot extending through the inside of the single-layer leg portion.
Figure 16:
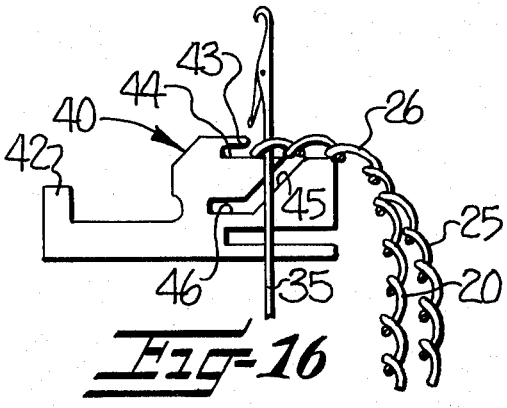

As the needles 35 successively move downwardly to form the stitch loops of the first course of the outer layer 26, these stitch loops are drawn downwardly by the needles 35 and are formed through the joined-together stitch loops of the last courses of the leg 20 and the inner layer 25. The sinkers 40 are moved inwardly to the normal operating position so that the stitch loops of the first course of the outer layer 26 are drawn downwardly through the joined-together stitch loops of the last courses of the leg 20 and the inner layer 25 and the stitch loops of the outer layer 26 are formed over the regular stitch-forming ledges 44 of the sinkers 40. The remaining courses of the outer layer 26 are formed over the regular stitch-forming ledge portions 44 of the sinkers 40 as the needles take body yarn and draw the same down through the stitch loops of the preceding course, as illustrated in FIG. 16. Knitting of the inner layer 26 continues, as illustrated in FIG. 8, until the desired number of courses have been formed to form substantially the same length as the length of the inner layer 25 and then the fabric is shed from the needles and the stocking blank falls from the lower end of the needle cylinder in the condition shown in FIG. 9.

The knitting machine operator then removes the stocking blank and pulls the inner layer 25 through the leg 20 and into position inside of the outer layer 26 so that the lower free ends of the inner and outer layers 25, 26 are substantially in alignment with each other. The sock is then completed by simply forming the curved overedge toe closure seam 28 to join the lower ends of the inner and outer layers 25, 26 together. If the lines of stitching 30 are to be used, it is preferred that they be formed completely around the foot before the toe closure seam 28 is formed.

The completed sock, as illustrated in FIGS. 1 and 2 includes a single-layer leg portion 20 knit of successive courses including a predetermined number of stitch loops forming adjacent wales in successive courses and a double-layer foot portion 24 which is knit integral at its upper end with the lower end of the leg portion. The double-layer fabric extends completely around the foot portion and covers the toe, heel, sole and instep areas of the foot of the wearer. The forward or lower ends of the inner and outer layers 25, 26 are connected together by the toe closure seam 28. The inner and outer layers 25, 26 include an equal number of wales and the number of wales in the inner and outer layers is also the same as the number of wales in the leg 20.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a sock including a single-layer leg portion knit of successive courses including a predetermined number of stitch loops forming adjacent wales in successive courses, and a foot portion knit integral with said leg, said foot portion including toe, heel, sole, and instep areas with said toe area including a closure seam, the improvement wherein at least a substantial portion of said foot portion comprises double-layer fabric providing improved cushioning characteristics, said double-layer fabric including separate inner and outer layers each extending completely around said substantial portion of said foot portion, said inner and outer layers each comprising an independently knit and separate layer and including an equal number of wales and the number of wales in said inner and outer layers being the same number of wales as the number of wales in said leg, and said inner and outer layers each including forward ends connected together by said toe portion closure seam and rear ends integrally knit with each other in a continuous manner and being integrally knit with said single-layer leg portion.

2. A sock according to claim 1 wherein said substantial portion of said foot portion includes moisture-absorbing characteristics and wherein said inner layer is knit of hydrophobic yarn, and wherein said outer layer is knit at least in part of hydrophilic yarn so that the moisture from the foot of the wearer is wicked through said inner layer and into said outer layer and evaporated therefrom.

3. A sock according to claim 1 wherein said two-layer fabric extends for the full length of said foot portion and the rear ends thereof are integrally knit with the lower end of said leg.

4. A sock according to claim 1 wherein terry loops are provided on the inner surface of said outer layer to provide additional cushioning.

5. A sock according to claim 1 wherein terry loops are provided on the outer surface of said inner layer to provide additional cushioning.

6. A sock according to claim 1 wherein terry loops are provided on the inner surface of said outer layer and on the outer surface of said inner layer to provide further improved cushioning.

7. A sock according to claim 1 including stitching means spaced rearwardly of said toe portion and connecting said inner and outer layers to maintain said inner layer in fixed relationship with said outer layer.

8. A sock according to claim 7 wherein said stitching means comprises at least one line of stitching completely surrounding said foot portion, and penetrating through said inner and outer layers.

9. A sock according to claim 8 wherein said stitching means comprises a pair of parallel spaced-apart lines of stitching spaced rearwardly of said toe portion and rearwardly of the portion of said foot normally occupied by the ball of the foot of the wearer.

10. A sock blank including a single-layer leg knit of successive courses including a predetermined number of stitch loops forming adjacent wales in said successive courses, a foot portion knit integral with said leg and comprising double-layer fabric extending throughout at least a substantial portion of said foot portion, said double-layer fabric including independently knit and separate inner and outer layers, each of said layers extending completely around said substantial portion of said foot portion and including rear and forward ends, said rear end of said inner layer and said rear end of said outer layer being integrally knit with each other in a continuous manner and being integrally knit with said single-layer leg, said forward end of said inner layer and said forward end of said outer layer terminating in substantial alignment so that a toe closure seam may be formed to join the two layers together and form a toe pocket.

11. A method of knitting a sock blank on a circular hosiery knitting machine including a circle of latch needles, said sock including cushioning double-layer fabric extending throughout at least a substantial portion of the foot, said method comprising the steps of knitting a single-layer leg while forming stitch loops on all needles and knitting successive courses including a predetermined number of adjacent wales of stitch loops, transferring the stitch loops of the last course of the leg to a position to be held below the latches of the needles, forming a makeup on the needles and knitting an inner layer of the foot while continuing to hold the stitch loops of the last course of the leg below the latches of the needles, transferring the held stitch loops of the last course of the leg to a position above the latches of the needles so that these stitch loops are joined with the stitch loops in the last course of the inner layer of the foot, knitting the first course of an outer layer of the foot integral with the last course of the inner layer of the foot and the last course of the leg, and then continuing to knit successive courses of the outer layer until substantially the same number of courses have been knit in said outer layer as were knit in said inner layer.

12. A method of knitting a sock blank according to claim 11 including the step of knitting terry loops on the inner surface of the outer layer of the foot.

13. A method of knitting a sock blank according to claim 11 including the step of knitting terry loops on the inner surface of the inner layer of the foot.

14. A method of knitting a sock blank according to claim 11 including the steps of knitting terry loops on the inner surface of the outer layer, and knitting terry loops on the inner surface of the inner layer.

* * * * *